United States Patent [19]

Locher

[11] Patent Number: 4,668,012

[45] Date of Patent: May 26, 1987

[54] CHAIR WITH SWIVELLING SEAT AND BACKREST PORTIONS

[75] Inventor: Hermann Locher, Dornach, Switzerland

[73] Assignee: Giroflex Entwicklungs Ag, Koblenz, Switzerland

[21] Appl. No.: 652,496

[22] Filed: Sep. 19, 1984

[30] Foreign Application Priority Data

Oct. 5, 1983 [CH] Switzerland ..... 5418/83

[51] Int. Cl.[4] ..... A47C 1/03

[52] U.S. Cl. ..... 297/300; 297/301

[58] Field of Search ..... 297/300, 301, 316, 320

[56] References Cited

U.S. PATENT DOCUMENTS

| | | | |
|---|---|---|---|
| 3,989,297 | 11/1976 | Kerstholt | 297/300 |
| 4,143,910 | 3/1979 | Geffers | 297/301 |
| 4,362,335 | 12/1982 | Drabert et al. | 297/300 |
| 4,432,582 | 2/1984 | Weismann et al. | 297/300 X |
| 4,502,729 | 3/1985 | Locher | 297/300 |
| 4,509,793 | 4/1985 | Weismann et al. | 297/300 X |

*Primary Examiner*—Peter A. Aschenbrenner

*Attorney, Agent, or Firm*—Werner W. Kleeman

[57] ABSTRACT

The seat member and the back member are adjustably mounted at each side of the chair in two support bearings or pivot joints of a chair base and are connected to one another by a third pivot joint. The seat member comprises an extension in the direction of the back member while the back member is maintained in spaced relationship to the third pivot joint by part of a lower strut portion on each side of the chair. A spring element is mounted at its ends on the free end of the extension part of the seat member and on the back member. In transition from the working position (full lines) into the relaxed or reclined position (broken lines), a relative motion is superimposed upon the pivoting motions of the seat member and of the back member. This relative motion produces unequal vertical downward displacements of the free end of the seat extension and of the backrest portion where it joins the strut portion. The action of this relative motion avoids the otherwise inevitable stretch effect on the occupant of the chair without requiring the supplementary linkages employed in known constructions.

11 Claims, 4 Drawing Figures

CHAIR WITH SWIVELLING SEAT AND BACKREST PORTIONS

BACKGROUND OF THE INVENTION

The present invention broadly relates to an article of furniture and, more specifically, pertains to a new and improved construction of an adjustable chair or seat structure.

Generally speaking, the chair of the present invention has a supporting framework on which a seat member and a back member are supported. The back member comprises a backrest portion and a strut portion. The seat member and the back member are coupled together by means of a pivot joint and are subject to the action of at least one spring element. The seat member and the back member can be adjusted to different angular positions. During the transition from one position to another, a relative motion is superimposed upon the pivoting or swivelling motion of the seat member and of the back member. It will be understood that the seat member and the back member are structural or frame members for supporting upholstery or panel members.

Chairs having both adjustable seats and adjustable back members are known in various forms. They allow the occupant to assume a working position on the one hand, in which the back member is nearly vertical and provides support for the back of the occupant, and a relaxing or reclined position on the other hand. Such chairs have a seat and a back member that are coupled together and angularly adjustable with respect to a supporting framework. The supporting framework is usually structured as a chair base upon which the seat and the back member are pivotably mounted.

The degree of comfort provided by such chairs is disturbed by the fact that in the transition to another seating position, especially in the transition from a working position to a relaxing or reclining position, the occupant is subjected to an undesirable stretching effect. This stretching effect can only be avoided by not using the backrest during the change of position.

In order to avoid this stretching effect, various solutions have been proposed. Among them is a construction disclosed in German Patent Publication No. 3,152,945 which is based upon a previously known construction having an angularly adjustable seat and an angularly adjusted back member coupled to the seat. In order to avoid the stretching effect, a supplementary linkage is provided which is connected to a back support portion that is perpendicularly slidable in relation to the back member. If the position of the chair is changed, the back support portion executes a supplementary motion relative to the back member. If the back upholstery is fastened to the back member, the desired avoidance of the stretching effect is obtained.

It should be obvious that this known construction constitutes a very complicated solution. In particular, the back support portion controlled by the supplementary linkage to be slidable in relation to the back member is a construction comprising a great many components which must be manufactured with an appropriate degree of accuracy.

SUMMARY OF THE INVENTION

Therefore, with the foregoing in mind, it is a primary object of the present invention to provide a new and improved construction of an adjustable chair which does not have associated with it the aforementioned drawbacks and shortcomings of the prior art constructions.

Another and more specific object of the present invention aims at providing a new and improved construction of an adjustable chair of the previously mentioned type which avoids the aforementioned stretching effect without requiring more components than are required for the aforementioned simple but unsatisfactory solution.

Yet a further significant object of the present invnention aims at providing a new and improved construction of an adjustable chair of the character described which is relative simple in construction and design, extremely economical to manufacture, highly reliable in operation, not readily subject to breakdown or malfunction and reqiures a minimum of maintenance and servicing.

Now in order to implement these and still further objects of the invention, which will become more readily apparent as the description proceeds the adjustable chair of the present invention is manifested by the features that the seat member comprises a strut extension passing beyond the pivot joint in the direction of the back member and the lower support strut of the back member comprises an extended portion uniting the back member with the pivoted joint.

More specifically, the invention comprises an adjustable chair containing a base construction or portion, a swivel joint mounted at the base portion and a rigid supporting framework or shell mounted on the swivel joint. A back member is pivotably mounted by a first pivot means or joint on the supporting framework for adjustably supporting the back of a seated occupant. The back member has a substantially vertical backrest portion and a lower strut portion connecting the backrest portion with the first pivot joint. A seat member is pivotably and slidably mounted to the supporting framework by a second pivot means or joint and to the lower strut portion of the back member by a third pivot means or joint for supporting the buttock region of a seated occupant. The seat member has a cantilevered free end extending beyond the third pivot joint in the direction of the backrest portion of the back member. Spring means or a spring element connects the free end of the seat member to the backrest portion of the back member. A pivot joint common to the seat member and the lower strut portion of the back member forms the third pivot joint. This third pivot joint is located at a region in the lower strut portion of the back member intermediate to the first pivot joint and the lower regon of the backrest of the back member.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
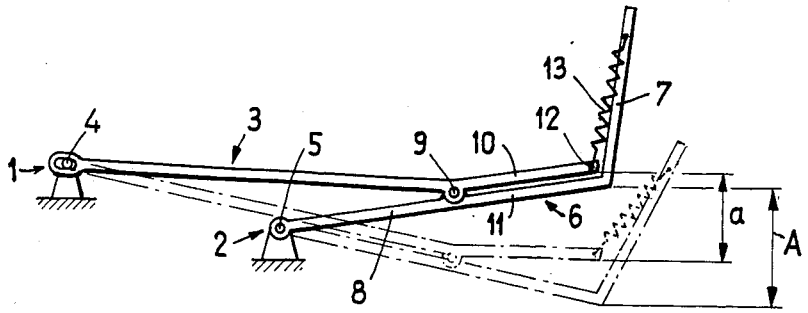
FIG. 1 is a kinematic rigid body diagram of a chair constructed according to the invention.

FIG. 1 shows a kinematic rigid body diagram of a chair without its base, the chair base portion being represented by two bearing or pivot points 1, 2 disposed in fixed spaced relationship. A seat frame member 3 is mounted at a bearing or pivot joint 1 by means of a sliding pivot joint 4. A back member 6 is mounted at a bearing or pivot joint 2 by means of a fixed pivot joint 5. The back member 6 comprises a backrest portion 7 and a lower strut portion or support strut 8 at each side of the chair, i.e. at least two lower strut members 8 Each lower support strut 8 is coupled to the seat member 3 by means of a related pivot joint 9. It is important the the seat member 3 comprises a cantilevered extension 10 extending from the pivot joint 9 into the region of the backrest 7. Each lower strut portion 8 also comprises a strut extension 11 which extends in a similar manner from the related pivot joint 9 in the direction of the backrest 7 and supports the backrest. The position of the individual components represented in full lines in FIG. 1 corresponds to the working position, i.e., the backrest 7 assumes an approximately vertical position for supporting the back of the occupant.

In order that this position be automatically maintained, the free end 12 of the cantilevered extension 10 is connected to the backrest 7 by at least one spring element, for instance a mechanical compression spring element 13' or a gas-filled spring element 13. The arrangement of one or several spring elements 13 need not, however, be exclusively in the region of backrest portion 7. The seat member 3 and the back member 6 can also be restrained by the spring element or elements in other manners, for instance in that one end of the spring element engages the chair base portion and the other end acts either on the back member 6 or on the seat member 3. This arrangement is advantageously so designed that the appearance of the chair is not detrimentally affected.

The relaxing or reclining position of the chair is shown in broken lines in FIG. 1 where it can be seen that, for instance, the back member 6 is subject to a greater vertical downward displacement A at the transition region of the backrest portion 7 and the extension 11 of the lower strut portion 8 than is the case for the vertical downward displacement a of the free end 12 of the seat member 3. Therefore, in the transition from the working position through a continuous range of inclined positions into the relaxing or reclined position both components 3 and 6 execute a swivelling or pivoting motion. A supplementary relative motion is superimposed upon these pivoting motions which has the effect of producing the difference in vertical displacements A and a. By appropriate selection of the length of the cantilevered extension 10 and of the extension 11 of the lower strut portion 8, this superimposed relative motion can be proportioned to practically avoid the aforementioned stretching effect.

In view of the symmetrical nature of the kinematics of the chair structure, such chair structure has been described hitherto in relation to a single side only of the chair. In the description of the practical embodiment which follows, reference will be made to structural elements at both sides of the chair.

Figure 3:
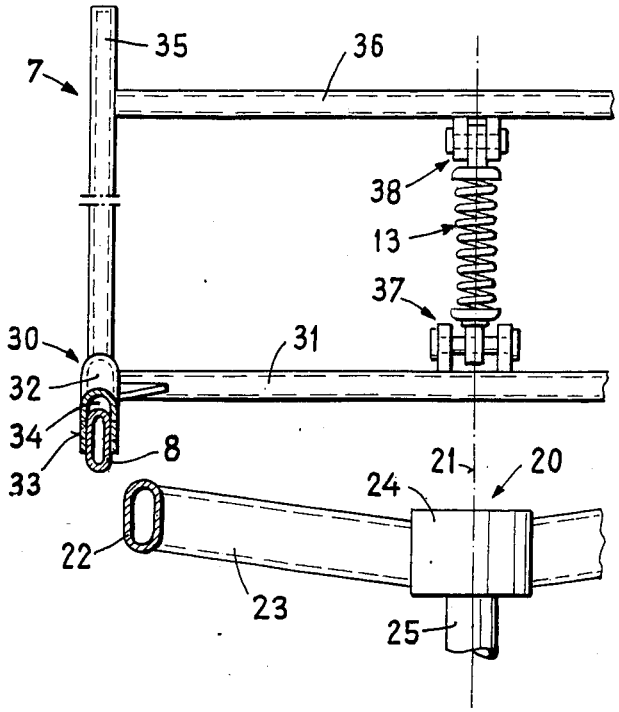
FIG. 3 is a schematic section along line III—III in FIG. 2.
Figure 2:
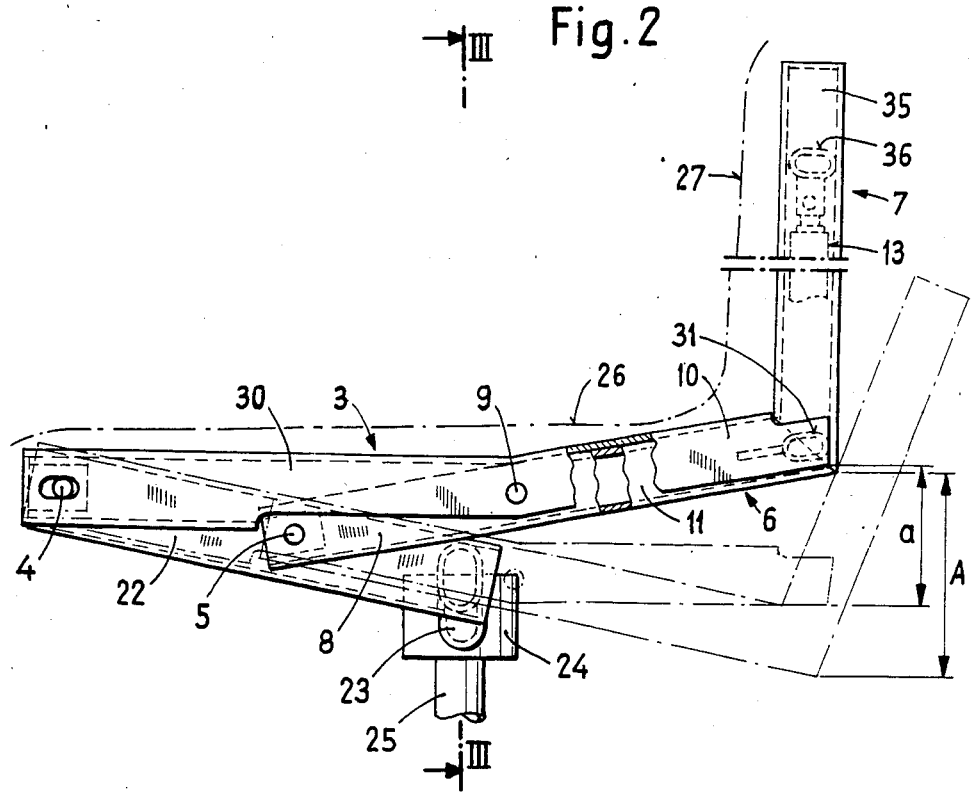
FIG. 2 is a schematic representation of a design for a chair having the kinematic arrangement of FIG. 1.
Figure 4:
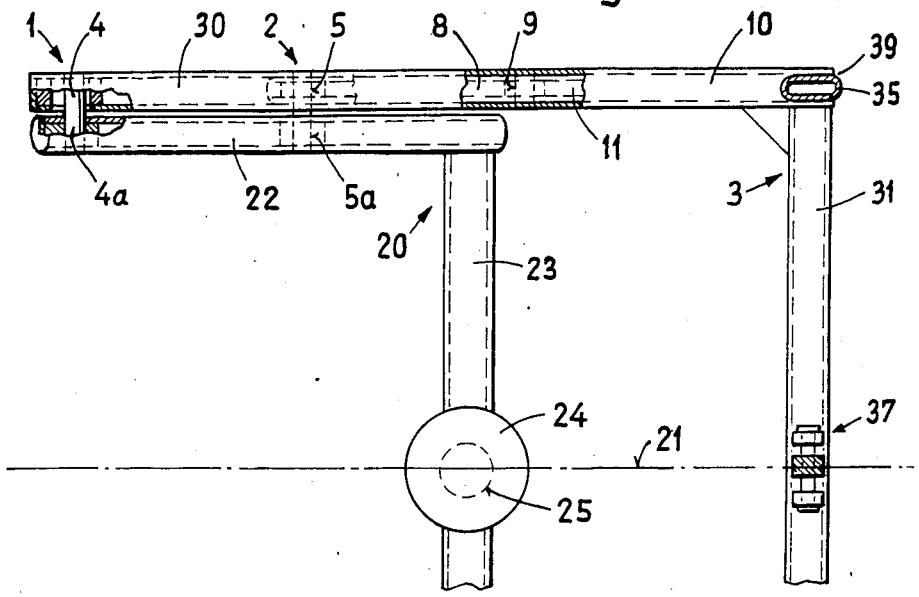
FIG. 4 is a schematic plan view, partially in section, of the chair according to FIG. 2.

FIGS. 2 through 4 show such a practical embodiment of the kinematic diagram of FIG. 1, generally using the same reference numbers for the same parts as in FIG. 1. In FIG. 2, both of the fixed bearing or pivot joints or points 1 and 2 are replaced by a supporting framework 20 comprising support rails 22 disposed on either side of the plane of symmetry 21 of the chair and interconnected by lateral struts 23 supported on a swivel head structure 24. The swivel head 24 can be mounted on a substantially vertical swivelling column 25 of the chair base portion. The supporting framework 20 can, for instance, be part of a suitable chair base (not particularly shown in the drawings) having a central column supported on a suitable foot construction and providing support for the swivel column 25. A seat portion 26, for instance a seat upholstery shown in broken lines in FIG. 2, is supported by seat member 3. Similarly, a back portion 27, for instance a back upholstery, is shown in broken lines on backrest portion 7. The elements 26 and 27 participate in the motions of the corresponding components 3 and 6. The components 3 and 6 execute, as was described above in relation to FIG. 1, different vertical downward displacements A and a.

The seat member 3 comprises a frame or framework which will be better understood by reference to FIG. 4. The framework comprises two hollow section side rails or channel section side rails 30 assembled from hollow profiled sections and disposed symmetrically to the plane of symmetry 21 of the chair. They are interconnected by a transverse strut 31. The hollow section side rails 30 are formed by two telescoped channels 32 and 33 as will be better understood by reference to FIG. 3. The lower channel 33 forms an aperture or slot 34 for accommodating a lower support strut 8. This aperture or slot 34 defines an opening of the lower channel 33. Two back columns 35 are connected to the two lower support struts 8 and are interconnected by back rails 36. The back columns 35, the back rails 36 and the lower support struts 8 constitute the framework of the backrest portion 7. The transverse strut 31 of the base and the back rail 36 of the backrest portion are each provided with a pair of anchors or webs 37 and 38 which are bored to accommodate suitable pivot pins of engaging the respective ends of the spring element or spring elements 13.

In the work position illustrated in FIGS. 1 and 2, not only do the lower strut portions 8 lie in the slots or apertures 34 of the hollow section side rails 30, but also both back columns 35 extend, in the region of their transition to the lower strut portions 8, to engage apertures or openings 39 at the ends of the hollow section side rails 30 nearest to the back member 6. The apertures 34 and 39 provide limit stops for the working position of the back member 6.

The embodiment of the chair represented in FIGS. 2 through 4 constitutes not only a simple but also a space-saving solution. The lower strut portions 8 lie at least partially within the hollow section side rails 30 of the seat member 3. In FIG. 2 the relaxing or reclined position of the chair is also represented in broken lines. The unequal vertical downward displacements A and a of the hollow section side rails 30 and of the lower strut portions 8 are visible.

The embodiment of the chair shown in FIGS. 2 through 4 comprises the hollow section side rails 30 disposed in spaced relationship and the lower strut portions 8 also disposed in spaced relationship. If this spaced relationship is further and further reduced, an embodiment is approached in which each hollow section side rail 30 and each lower strut portion 8 fuse into a single component. Apertures for the swivel head 24 and for the spring element or elements 13 would have to be provided in the hollow seat member 3 and in the hollow back member 6, respectively. The seat portion 26 and the backrest portion 27 can easily be supported on this single piece or monocoque construction.

In the embodiment described, closed steel tubes of elliptical cross-section have been preferably employed (see especially the lower strut portions 8, the backrest columns 35, the transverse and lateral struts 31 and 36 and the support side rails and lateral struts 22 and 23 of the supporting framework 20). However, other steel profiles can equally well be employed. Especially in the aforementioned single piece or monocoque construction, cast or forged steel components can be employed. A further alternative embodiment of the chair of the invention employs torsion spring or bar means installed in at least one of the pivot joints 4 and 5 as the spring element as generally indicated by reference characters 4*a* and 5*a* in FIG. 4. In yet a further embodiment, the pivot joint 5 could be designed as a slidable pivot joint while the slidable pivot point 4 could be a fixed pivot joint. The sliding displacement is relatively small in any case, i.e., only a few millimeters, since the pivot joint 9 is located at a region of the seat member 3 and the lower strut portion 8 of the back member 6 where the tangents to the arcs described by both members about their respective pivot points nearly coincide.

While there are shown and described present preferred embodiments of the invention, it is to be distinctly understood that the invention is not limited thereto, but may be otherwise variously embodied and practiced within the scope of the following claims. Accordingly,

What I claim is:

1. An article of furniture, especially a chair, comprising:

a chair base portion having a forward edge and provided with first transverse pivot joint means adjacent said forward edge and second transverse pivot joint means spaced from said first transverse pivot joint means by a predetermined distance;

a seat frame member pivotably supported at a forward region thereof on said chair base portion by said second transverse pivot joint means for performing pivoting motion about said second transverse pivot joint means;

a back frame member including a backrest portion and at least two lower strut members for pivotably supporting said back frame member at a forward region thereof on said first transverse pivot joint means of said chair base portion for performing pivoting motion about said first transverse pivot joint means;

third transverse pivot joint means directly coupling said seat frame member to said back frame member intermediate the first transverse pivot joint means and the backrest portion;

at least one spring element resiliently interconnecting said seat frame member and said back frame member;

said seat frame member and said back frame member defining a continuous range of positions of inclination for the article of furniture extending between a substantially upright working position and a substantially reclined relaxing position and being conjointly inclinable into different positions of inclination of said continuous range of positions of inclination by means of a conjoint pivoting motion relative to said chair base portion about said first and second transverse pivot joint means in which conjoint pivoting motion said back frame member pivots about said first transverse pivot joint means and in which conjoint pivoting motion said third transverse pivot joint means constrains said seat frame member to pivot about said second transverse pivot joint means;

said second transverse pivot joint means for said seat frame member and said first transverse pivot joint means for said back frame member being arranged at said predetermined distance such that said seat frame member executes an angular displacement relative to said back frame member in addition to said conjoint pivoting motion when said seat frame member and said back frame member execute said conjoint pivoting motion for inclining from one said different position of inclination to another said different position of inclination;

said seat frame member including a cantilever member extending beyond said third transverse pivot joint means toward said back frame member for supporting said at least one spring element such that said angular displacement alters the state of said at least one spring element; and each of said at least two lower strut members including a strut extension for directly connecting said back frame member to said third transverse pivot joint means.

2. The article of furniture as defined in claim 1, wherein:

said at least one spring element resiliently interconnecting said seat frame member and said back frame member has a first end region and a second end region;

said cantilever member of said seat frame member having a free end; and said at least one spring element resiliently interconnecting said seat frame member and said back frame member being supported at said first end region thereof on said back frame member and at said second end region thereof on said free end of said cantilever member of said seat frame member.

3. The article of furniture as defined in claim 1, wherein:

said at least one spring element resiliently interconnecting said seat frame member and said back frame member comprises a gas-pressure spring element.

4. The article of furniture as defined in claim 1, wherein:

said at least one spring element resiliently interconnecting said seat frame member and said back frame member has a first end region and a second end region;

said first end region being supported on said seat frame member; and said second end region being supported on said chair base portion.

5. The article of furniture as defined in claim 1, further including:

said first transverse pivot joint means defining a first pivot joint structure provided on said at least two lower strut members of said back frame member;

said second transverse pivot joint means defining second pivot joint structure provided on said seat frame member; and said at least one spring element resiliently interconnecting said seat frame member and said back frame member comprising torsion spring means fixed in a selected one of said first transverse pivot joint means defining said first pivot joint structure and said second transverse pivot joint means defining said second pivot joint structure for resiliently interconnecting said seat frame member and said back frame member through said selected one of said first transverse pivot joint means defining said first pivot joint structure and said second transverse pivot joint means defining said second pivot joint structure and through the intermediary of said chair base.

6. The article of furniture as defined in claim 5, wherein:

said seat frame member has a side oriented toward said chair base portion and an end oriented toward said back frame member; and said seat frame member comprising at least one channel section side rail having a first opening at said side thereof oriented toward said chair base portion and a second opening at said end thereof oriented toward said back frame member.

7. The article of furniture as defined in claim 6, wherein:

said seat frame member comprises a first framework;

said first framework including two mutually spaced channel section side rails and a transverse strut;

said two mutually spaced channel section side rails each having an end oriented toward said back frame member;

said two mutually spaced channel section side rails each having a first predetermined cross-section;

said two mutually spaced channel section side rails each having an end region at said end oriented toward said back frame member;

said transverse strut interconnecting said two channel section side rails at said end regions thereof;

said back frame member comprising a second framework directly pivotably connected to said first framework by said third transverse pivot joint means;

said second framework including two lower strut members having a second predetermined cross-section smaller than said first predetermined cross-section for fitting into said first openings of said two mutually spaced channel section side rails;

said second framework including two structural back column members having a predetermined third cross-section smaller than said first predetermined cross-section for fitting into said second openings of said two mutually spaced channel section side rails; and said second framework including a structural back rail member interconnecting said two structural back column members at a location above said transverse strut.

8. The article of furniture as defined in claim 7, wherein:

said at least one spring element resiliently interconnecting said seat frame member and said back frame member has a first end supported on said transverse strut and a second end supported on said structural back rail member.

9. The article of furniture as defined in claim 7, wherein:

said at least one spring element resiliently interconnecting said seat frame member and said back frame member comprises a plurality of spring members; and said plurality of spring members each having a first end supported on said transverse strut and a second end supported on said back rail.

10. The article of furniture as defined in claim 1, wherein:

said chair base portion has a substantially vertical plane of symmetry extending substantially through the center of said chair base portion;

said chair base portion comprising one support rail at each side of said plane of symmetry for pivotably supporting said seat frame member on said second transverse pivot joint means and said back frame member on said first transverse pivot joint means;

said chair base portion further including a lateral strut connected to each said support rail and means defining a rotatably journalled swivel head structure; and each said support rail being supported on said swivel head structure by said therewith connected lateral strut.

11. The article of furniture as defined in claim 10, further including:

means defining a sliding pivot joint structure between said seat frame member an said support rail; and said sliding pivot joint structure comprising a pivot pin and an elongate pivot bearing.

* * * * *